United States Patent [19]

Richards, Sr.

[11] 4,138,868

[45] Feb. 13, 1979

[54] REPLACEABLE CYLINDER PADLOCK

[76] Inventor: Frederick F. Richards, Sr., 6837 Chevy Chase, Dallas, Tex. 75224

[21] Appl. No.: 826,021

[22] Filed: Aug. 19, 1977

[51] Int. Cl.[2] ..... E05B 67/22

[52] U.S. Cl. ..... 70/38 A; 70/367

[58] Field of Search ..... 70/38 A, 38 R, 38 B, 70/38 C, 39, 367, 368, 369, 370, 371

[56] References Cited

U.S. PATENT DOCUMENTS

| | | | |
|---|---|---|---|
| 1,636,381 | 7/1927 | Megie | 70/38 B |
| 1,660,903 | 2/1928 | Adamson | 70/38 A |
| 2,460,615 | 2/1949 | Andrew | 70/38 A |
| 2,691,288 | 10/1954 | Childs | 70/38 A |

*Primary Examiner*—Robert L. Wolfe

[57] ABSTRACT

In a padlock having a ball-locked shackle and a removable key-operated cylinder:

A cam retaining means consisting of a serrated pin in combination with a coiled spring;

A shackle retaining means comprising a tapped shackle end and a threaded flanged member in conjunction with a ball and cam detent.

3 Claims, 7 Drawing Figures

REPLACEABLE CYLINDER PADLOCK

BACKGROUND OF THE INVENTION

Padlocks have previously been provided in which ends of the shackle are both engaged when the device is locked.

Among such previous padlocks are those in which a single plate is rotated into and out of engagement with the toe and heel of the shackle. Another type captures two balls between recesses in the toe and heel of the shackle and an extension of a longitudinally slideable key plug. Another type of padlock using two balls confines the balls between recesses in the shackle and a rotatable cam to lock the shackle, but this type does not have a removable key-operated cylinder.

The means by which the various members and parts are retained within a padlock body limit the ready exchange of cylinders within a padlock body and previous inventions have not produced a lock which has been acceptable to the locksmiths.

OBJECT OF THE INVENTION

This invention relates to a padlock and expecially to a type in which a shackle member is locked into the body by means of balls confined between recesses in the shackle and a rotatable cam member. Said cam member being actuated by a key-operated lock mechanism preferably of the pin-tumbler type. Said lock mechanism being removably retained within the padlock body.

It is an object of my invention to provide a padlock having a removable cylinder.

Another object is to use a common type of key-in-knob lock cylinder as furnished by various manufacturers for the cam actuating means in a padlock.

A still further object of my invention is to provide a padlock in which the retention of the various parts is accomplished by positive means.

Another object of my invention is to provide a padlock in which an actuating cylinder having one type of keyway can be interchanged with a cylinder having a different keyway.

A further object of this invention is to provide a padlock from which the cylinder can be removed without disturbing interior parts.

A still further object of my invention is to provide a retaining means for holding a cam member within a lock mechanism in which said retaining means also limits the degree of rotation of said cam.

A still further object of my invention is to provide a padlock in which locking is accomplished by balls confined between a rotatable cam and recesses in the shackle and in which a key operated cylinder is used to actuate said cam. Said cylinder being removable and replacable without disturbing said balls or said cam.

Another object in my invention is to provide a padlock in which a removable cylinder is removable only when the padlock is in an unlocked condition.

Similar reference characters refer to similar parts throughout the several views of the drawings.

Figure 1:
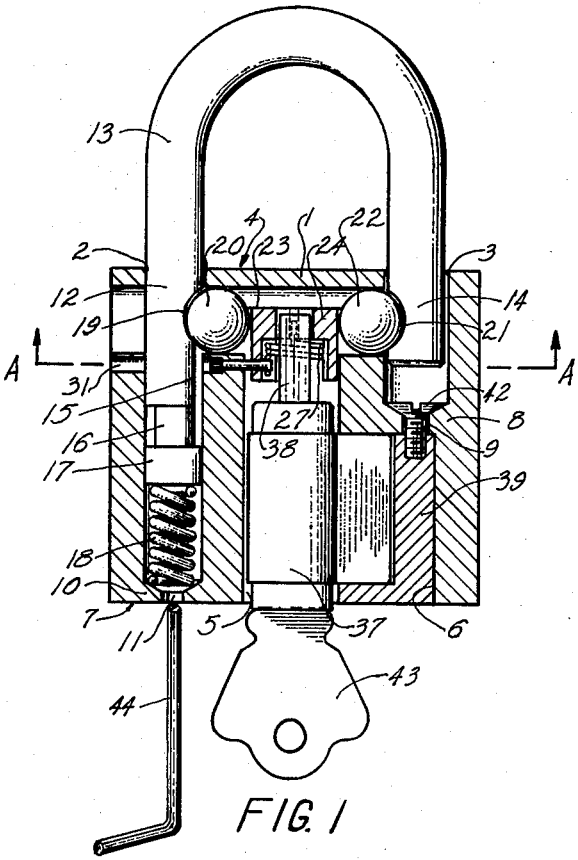
FIG. 1 is a vertical central sectional view through a padlock construction utilizing a key-in-knob cylinder, the construction being shown with parts in locked position.
Figure 2:
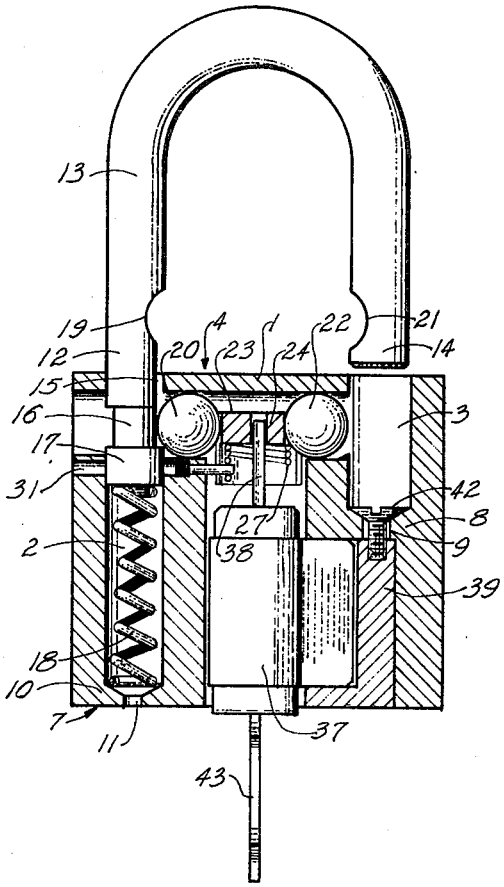
FIG. 2 is a view like that of FIG. 1 but with the parts in unlocked position.
Figure 3:
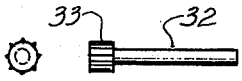
FIG. 3 is a detail view of a retaining pin having a serrated head.

Referring first to FIGS. 1 and 2, we first provide a casing structure generally designated 1. This is primarily a solid block of metal fabricated or machined to provide a pair of parallel recesses 2 and 3 which enter the body from the upper face 4 thereof and is likewise provided with a pair of parallel bores 5 and 6 which enter the body from the lower face 7 thereof. Said bores 5 and 6 are positioned to overlap in a fashion to remove a portion of the wall between them. The position of one of the bores 6 is such that it intersects the recess 3 in an offset fashion to provide an intervening wall 8 therebetween. The bottom of recess 3 is also provided with a countersunk hole 9 passing through intervening wall 8. Somewhat similarly recess 2 is terminated by a wall 10 through which passes a hole 11.

Slideably disposed within the recess 2 is the heel end 12 of a shackle member 13. The heel end is generally circular in cross section. Its lower end is provided with a planar flat face 15 merging with a circumferential groove 16 formed by a cold headed member 17 threadably attached to the heel end of said shackle member to leave a flange. A coil spring 18 is disposed within recess 2 and one end bears on the body 1 at the bottom of the recess and the other end bears against the lower face of cold headed member 17. Thus, the spring normally tends to push the shackle member 13 out of body 1. The heel of the shackle member 12 is slideably and rotatably carried by the cylindrical walls of recess 2 and extending centrally and transversely of the heel 12 and throughout a substantial distance from its end is a notch 19 into which rests a portion of ball 20 when the shackle is in a locked condition.

The toe end 14 of the shackle member 13 is alignable with recess 3 and has a notch 21 which is located directly opposite notch 19 and positioned to accept a portion of ball 22 when the shackle member is in a locked condition (FIG. 1).

Figure 6:
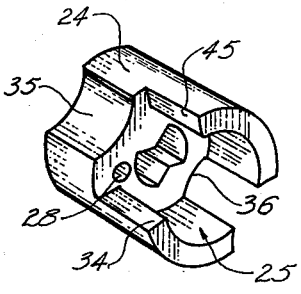
FIG. 6 is a perspective view of a rotatable cam member.
Figure 7:
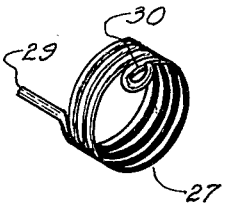
FIG. 7 is a perspective view of a coiled spring.

Bore 5 enters the body 1 from its lower face and terminates as a blind hole forming a cavity with a flat bottom 23. In the bottom of said cavity is placed a rotatable cam member 24 (a detail of which is shown in FIG. 6). A coil spring 27 (see FIG. 7) rests within a cavity 25 in said cam member 24 and a straight end 29 of spring 27 is inserted into a hole 28 in the bottom of cavity 25 in said cam member 24. The locked end 30 of said coiled spring 27 extends above cavity 25 in rotatable cam 24.

Figure 4:
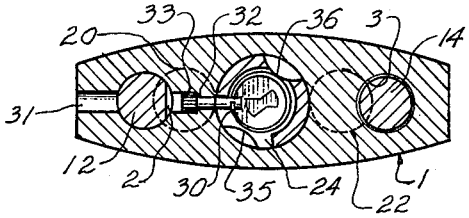
FIG. 4 is a vertical transverse sectional view, as seen along the line A—A of FIG. 1.

With this arrangement, the cam 24 with spring 27 in place is shown in FIG. 4 resting in the bottom of recess 5.

As illustrated in FIG. 4, a small hole 31 enters the side of body 1 perpendicular to recess 2 and passing into cavity 5 at a point to intersect the hooked end 30 of coiled spring 27 when said coiled spring is resting in cavity 25 of the cam 24 and cam 24 is resting at the bottom of recess 5.

A pin 32 having a serrated end 33 passes through small hole 31 and engages hook 30 on spring 27 thus securing cam 24 and spring 27 in the bottom of cavity 5 and leaving the serrated end 33 of pin 32 pressed into hole 31.

Said coiled spring 27 when attached by pin 32 is biased to rotate cam 24 until shoulder 34 strikes pin 32 when the padlock is in a locked condition.

A shoulder projection 45 located opposite shoulder 34 on said cam will contact said serrated pin 32 when said cam is rotated by said key thus limiting the degree of rotation of said cam.

Balls 20 and 22 are captivated between the circumference of cam 24 and shackle notches 10 and 21 when the padlock is in a locked condition. Rotating the cam 24 will further cock spring 27 and bring detents 35 and 36 on said cam in line with balls 20 and 22 allowing balls 20 and 22 to enter detents 35 and 36 thereby releasing balls 20 and 22 from notches 19 and 21 in the shackle 13. With balls 20 and 22 out of notches 19 and 21, the shackle 13 is free to be pushed by coil spring 18 out of said body 1 until the flange on cold headed member 17 reaches ball 20 where interference between ball 20 which has been limited in movement by a detent in said cam and said flange on cold headed member 17 occurs.

Figure 5:
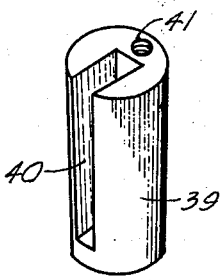
FIG. 5 is a perspective view of a cylinder retaining member.

A key-in-knob type cylinder 37 is inserted into recess 5 and interconnects by means of a tongue 38 with rotatable cam 24. A retainer member 39 (FIG. 5) having a longitudinal recess 40 extending a portion of its length and having a tapped hole 41 in its upper end is inserted into recess 6 with said longitudinal recess 39 enclosing an extension on cylinder 37. Said retainer member 39 forms a clamp in conjunction with body 1 to removably hold the cylinder 37 into recess 5. A screw 42 passes through countersunk hole 9 in intervening wall 8 to engage tapped hole 41 in said retainer member 39.

To actuate the cam and release balls 20 and 21 which are disposed on opposite circumferences of rotatable cam 24 a key 43 is used to operate cylinder 37 which drives cam 24 by means of tongue 38. Rotation of cam 24 by means of key 43 is limited by interference between serrated pin 32 and shoulders 34 and 45 on said cam 24.

To remove shackle 13 from the body 1, a wrench 44 can be inserted through hole 11 in bottom of recess 2 and made to engage a wrench engaging means on cold headed member 17, by means of said wrench cold headed member 17 can be unscrewed from the heel end 12 of said shackle member 13. Since the effective diameter of the planar flat 15 on the heel end of said shackle member is less than the head (flange portion) of the cold headed member 17, the shackle member is permitted to pass ball 20 when said padlock is in an unlocked condition, while cold headed member 17 is confined within recess 2 by interference between the flange on cold headed member 17 and ball 20.

Because the shackle 13 is removable, it can be replaced by another shackle having the same or different throat dimensions. Said cold headed member 17 remains within recess 5 because its flange is restricted by ball 20.

Thus, it will be seen that there has been provided in this invention a padlock construction in which various objects hereinbefore mentioned together with numerous thoroughly practical advantages are successfully achieved.

As many possible embodiments may be made of the above invention and as many changes might be made in the embodiment above set forth, it is to be understood that all matter hereinbefore set forth, or shown in the accompanying drawings, is to be interpreted as illustrative and not in a limiting sense.

I claim:

1. In a padlock comprising a body having a pair of parallel recesses therein and having a pair of parallel bores therein, one of said recesses and one of said bores communicating by means of a countersunk hole, a shackle having a toe end with notch receivable in said one recess and having a heel end with notch receivable in the other recess, a lock cylinder unit receivable in said one bore and a lock cylinder retaining means receivable in the other bore, a rotatable cam in said one bore and movable by lock cylinder means, a pin extending through a wall of said body and engaging a spring member fitted into a cavity in said rotatable cam, said pin acting to retain said rotatable cam and said spring within said one bore, a pair of ball members each interposed between said cam and a shackle end and respectively movable into or out of shackle and notches in accordance with the position of said cam.

2. In a padlock construction as claimed in claim 1 in which the pin means of retaining said cam in said one bore also limits the degree of rotation of said cam within said one bore by interference between said retaining means and projections on one end of said cam.

3. In a padlock construction as claimed in claim 1, a U-shaped shackle member having heel and toe ends slideably mounted for movement in respective recesses in a padlock body between a locked position wherein the ends are enclosed within the said body and an unlocked position wherein the toe end is separated from the said body, the sides of the heel and toe being formed with respective first and second notches, said heel end having a flat extending from its respective notch to the physical end of said shackle member, said heel end being concentrically drilled and tapped, a shoulder bolt member screwed into tapped hole in the end of said heel end and shackle member, said shoulder bolt having a head diameter equal to the diameter of said shackle member and a shoulder radius equal to the minimum radius left by the flat on end of said heel, said shoulder bolt member when screwed to heel end forming an extension to said heel end, said shoulder bolt member having a wrench engaging means in its head.

* * * * *